US007080598B2

(12) United States Patent
Creighton et al.

(10) Patent No.: US 7,080,598 B2
(45) Date of Patent: Jul. 25, 2006

(54) RAILWAY HOPPER CAR WITH LONGITUDINAL DISCHARGE OPENINGS

(75) Inventors: George S. Creighton, Flower Mound, TX (US); Joseph M. Sindelar, Houston, TX (US); John C. Herzog, West Chester, OH (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/926,381

(22) Filed: Aug. 25, 2004

(65) Prior Publication Data

US 2005/0056186 A1 Mar. 17, 2005

Related U.S. Application Data

(60) Provisional application No. 60/498,105, filed on Aug. 26, 2003.

(51) Int. Cl.
*B61D 3/00* (2006.01)

(52) U.S. Cl. ..... 105/247

(58) Field of Classification Search ..... 105/247, 105/249, 250, 251, 280, 282.2
See application file for complete search history.

(56) References Cited

U.S. PATENT DOCUMENTS

| | | | | |
|---|---|---|---|---|
| 2,011,155 A | * | 8/1935 | Neikirk | 105/415 |
| 3,408,956 A | | 11/1968 | Rebenok et al. | 105/240 |
| 3,501,030 A | | 3/1970 | Flink | 214/17 |
| 3,581,672 A | | 6/1971 | Aquino | 105/240 |
| 3,626,865 A | | 12/1971 | Aquino et al. | 105/240 |
| 3,800,711 A | | 4/1974 | Tuttle | 105/251 |
| 3,949,681 A | | 4/1976 | Miller | 105/284 |
| 3,965,760 A | | 6/1976 | Etheredge, Jr. | 74/89.14 |
| 4,136,621 A | | 1/1979 | Schuller et al. | 105/308 |
| 4,227,732 A | | 10/1980 | Kish | 294/71 |
| 4,246,849 A | | 1/1981 | Gramse | 105/251 |
| 4,250,814 A | | 2/1981 | Stark et al. | 105/251 |
| 4,262,601 A | | 4/1981 | Miller | 105/241.2 |
| 4,342,267 A | | 8/1982 | Blout | 105/282 |
| 4,450,773 A | | 5/1984 | Fritz et al. | 105/282 |
| 4,601,244 A | | 7/1986 | Fischer | 105/240 |

(Continued)

FOREIGN PATENT DOCUMENTS

GB J07564 A 0/1910

(Continued)

OTHER PUBLICATIONS

Notification of Transmittal of The International Search Report and The Written Opinion of the International Searching Authority, or the Declaration; PCT/US2004/027519; 14 pages, Mailed Nov. 30, 2004.

(Continued)

*Primary Examiner*—S. Joseph Morano
*Assistant Examiner*—Robert J. McCarry, Jr.
(74) *Attorney, Agent, or Firm*—Baker Botts L.L.P.

(57) ABSTRACT

A railcar with longitudinal discharge openings is disclosed. In one embodiment, the railcar includes an underframe, a pair of sidewall assemblies and a hopper formed between the sidewall assemblies. The underframe has a center sill and a pair of side sills. The center sill disposed between the pair of side sills along a generally longitudinally axis of the railcar. The hopper includes a discharge opening adjacent to the center sill. A respective discharge door assembly disposed adjacent to each discharge opening to control flow of lading from each hopper. Each discharge door may hinge from the center sill for movement between a first position and a second position relative to the discharge openings.

39 Claims, 12 Drawing Sheets

U.S. PATENT DOCUMENTS

| | | | | | |
|---|---|---|---|---|---|
| 4,766,820 | A | | 8/1988 | Ritter et al. | 105/240 |
| 4,829,908 | A | * | 5/1989 | Hallam | 105/240 |
| 4,930,427 | A | | 6/1990 | Ritter et al. | 105/406.1 |
| 5,115,748 | A | | 5/1992 | Westlake | 105/286 |
| 5,144,895 | A | | 9/1992 | Murray | 105/286 |
| 5,163,372 | A | | 11/1992 | Galvan et al. | 105/240 |
| 5,261,333 | A | | 11/1993 | Miller | 105/287 |
| 5,263,422 | A | * | 11/1993 | Barefoot | 105/308.1 |
| 5,351,582 | A | | 10/1994 | Snyder et al. | 81/57.17 |
| 5,868,045 | A | | 2/1999 | Hauk | 81/57.34 |
| 6,019,049 | A | * | 2/2000 | Gaydos et al. | 105/289 |
| 6,116,118 | A | | 9/2000 | Wesch, Jr. | 81/57.34 |
| 6,138,529 | A | | 10/2000 | Pietras | 81/57.33 |
| 6,279,487 | B1 | | 8/2001 | Gaydos et al. | 105/289 |
| 6,748,841 | B1 | | 6/2004 | Fritz | 87/57.41 |

FOREIGN PATENT DOCUMENTS

| | | | |
|---|---|---|---|
| GB | 07564 | A | 3/1910 |

OTHER PUBLICATIONS

Invitation to Pay Additional Fees; PCT/US2004/027508; 11 pages, Mailed Jun. 12, 2004.

PCT International Search Report, Application No. PCT/US2004/027508, 19 pages, Mailing Date Feb. 16, 2005.

Notification of Transmittal of The International Search Report and The Written Opinion of the International Searching Authority, or the Declaration; PCT/US2004/027519; 14 pages.

Invitation to Pay Additional Fees; PCT/US2004/027508; 11 pages.

* cited by examiner

RAILWAY HOPPER CAR WITH LONGITUDINAL DISCHARGE OPENINGS

RRELATED APPLICATIONS

This application claims the benefit of provisional patent application entitled, "Railway Hopper Car With Longitudinal Discharge Openings", Ser. No. 60/498,105 filed, Aug. 26, 2003.

This application is copending with patent application entitled, "Railcar With Discharge Control System", Ser. No. 10/926,370, filed Aug. 25, 2004.

TECHNICAL FIELD

The present invention is related in general to railcar and more particularly to hopper car for carrying bulk materials such as coal, ore, ballast, grain and any other lading suitable for transprotation in hopper cars.

BACKGROUND OF THE INVENTION

Railway hopper cars have been used for many years to transport and sometimes store bulk materials. Hopper cars generally include one or more of hoppers which may be used to hold cargo or lading during shipment. Hopper cars are frequently used to transport coal, sand, metal ores, ballast, aggregates, grain and any other type of lading which may be satisfactorily discharged through respective openings formed in one or more hoppers. Discharge openings are typically provided at or near the bottom of each hopper to rapidly discharge cargo. A variety of door assemblies and gate assemblies along with various operating mechanisms have been used to open and close discharge openings associated with railway hopper cars.

Hopper cars may be classified as open or closed. Hopper cars may have relatively short sidewalls and end walls or relatively tall or high sidewalls and end walls. The sidewalls and end walls of many hopper cars are often formed from steel or aluminum sheets and reinforced with a plurality of vertical side stakes or support posts. Some hopper cars include interior frame structures or braces to provide additional support for the sidewalls.

Applicable standards of the Association of American Railroads (AAR) established maximum total weight on rail for any railcar including boxcars, freight cars, hopper cars, covered hopper cars, gondola cars, tank cars and temperature controlled railway cars within prescribed limits of length, width, height, etc. All railcars operating on commercial rail lines in the U.S. must have exterior dimensions which satisfy associated AAR clearance plates. Therefore, the maximum load which may be carried by any railcar is typically limited by AAR standards for total weight on rail, applicable AAR clearance plate and empty weight of the railcar. Reducing the empty weight of a railcar and/or increasing interior dimensions may increase both volumetric capacity and maximum load capacity of a railcar while still meeting applicable AAR standards for total weight on rail and AAR clearance plate.

Longitudinally oriented discharge openings and associated gates have several advantages over transversely oriented discharge openings and associated gates on railcars, highway trucks, or other equipment having hoppers due to generally lighter weights, increased load capacity, and quicker discharge rates. Transversely oriented discharge openings and gates may be coupled with a common linkage operated by an air cylinder. The air cylinder is typically mounted in the same orientation as the operating gate linkage which is often a longitudinal direction relative to the associated hopper. Transverse gates may also open and close by separate operating assemblies that cause synchronization problems and require adjustments. Longitudinally oriented discharge openings and gates for prior hopper cars have often been used in pairs that may be rotated or pivoted relative to the center sill or side sills of a hopper car.

SUMMARY OF THE INVENTION

In accordance with teachings of the present invention, several disadvantages and problems associated with hopper cars with longitudinal discharge openings have been substantially reduced or eliminated. One embodiment of the present invention includes a hopper car having at least one hopper with longitudinal discharge openings formed adjacent to the bottom or lower portions of the hopper. Respective longitudinal door assemblies may be provided adjacent to each discharge opening. Longitudinal doors formed in accordance with teachings of the present invention may be easily opened to rapidly discharge lading from an associated hopper with only minimal operator assistance.

A hopper car formed in accordance with teachings of the present invention preferably includes one or more interior supporting structures which optimize load carrying capability while minimizing empty car weight of the hopper car. The interior supporting structures allow forming relatively large, longitudinal discharge opens for rapid discharge of lading between associated rails.

Technical benefits of the present invention include reducing the empty car weight of a hopper car while often increasing load carrying capability, reducing maintenance requirements and increasing service life of the hopper car. For example, in one application, a coal hopper car may be designed with a cross-braced interior structure and lightweight longitudinal doors. Due to the cross-brace structure and doors, the empty car weight of the hopper car incorporating teachings of the present invention may be reduced by approximately twenty-four hundred pounds (2400 lbs.) as compared with a prior coal hopper car designed to satisfy the same AAR clearance plate and other AAR specifications.

Further technical benefits of the present invention include providing longitudinal doors or gates which are lighter in weight and less expensive to manufacture as compared some prior longitudinal doors or gates associated with some hopper cars. Teachings of the present invention allow forming larger discharge openings which result in faster, more complete unloading of coal and similar types of lading which may have a tendency to stick or freeze when the associated hopper car is unloaded during wet or wintertime conditions.

One aspect of the present invention includes providing a hopper car with longitudinal discharge openings formed adjacent to a center sill. Respective longitudinal doors for each discharge opening may be formed in part from swinging slope sheets. For some applications, the swinging slope sheets may be hinged adjacent to the center sill. Various types of operating mechanisms may be disposed within or under the center sill to move the longitudinal doors or swinging slope sheets between a first, closed position and a second, open position.

Interior supporting structures or interior cross brace assemblies formed in accordance with teachings of the present invention may reduce the empty car weight of a hopper car while at the same time allowing the hopper car to carry the same or even greater load as compared with conventional hopper cars having similar AAR specifications and the same AAR clearance plate. For some applications a hopper car may be formed in accordance with teachings of the present invention with two or more hoppers divided by interior partitions.

A further technical benefit of the present invention includes a reduced weight or lighter cross bracing structure. Typically, conventional cross bracing uses heavy gauge metal components to form a brace within the hopper car extending from each side to support the lading placed within the car. By forming a lower horizontal brace between a center sill and a lower slope sheet, the cross bracing structure may use lighter or smaller gauges of metal to form the horizontal components and other cross bracing structures. In some embodiments of the present invention, the lower horizontal cross brace allows for a reduced empty weight of a hopper car while at the same time allowing the hopper car to carry the same or even greater load as compared with conventional hopper cars.

Still further technical benefits of the present invention include attaching longitudinal doors or swinging longitudinal slope sheets adjacent to a center sill or other centrally located structure using hinge mechanisms which substantially reduce requirements for reinforcement of the longitudinal doors or swinging longitudinal slope sheets. The longitudinal discharge openings and associated swinging longitudinal slope sheets cooperate with each other to allow increasing the load carrying capacity of a hopper car and lowering the center of gravity of the hopper car. Placement of the operating mechanism under the center sill will generally remove the operating mechanism from the flow of coal or other lading during discharge from the hopper car.

One embodiment of the present invention may include an articulated railway car having two or more car bodies. For example, a first hopper car and a second hopper car may be mounted on three articulated railway car trucks. A discharge control system formed in accordance with teachings of the present invention may be satisfactorily used to control opening and closing of doors or gates associated with each car body of the articulated railway car.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Figure 1:
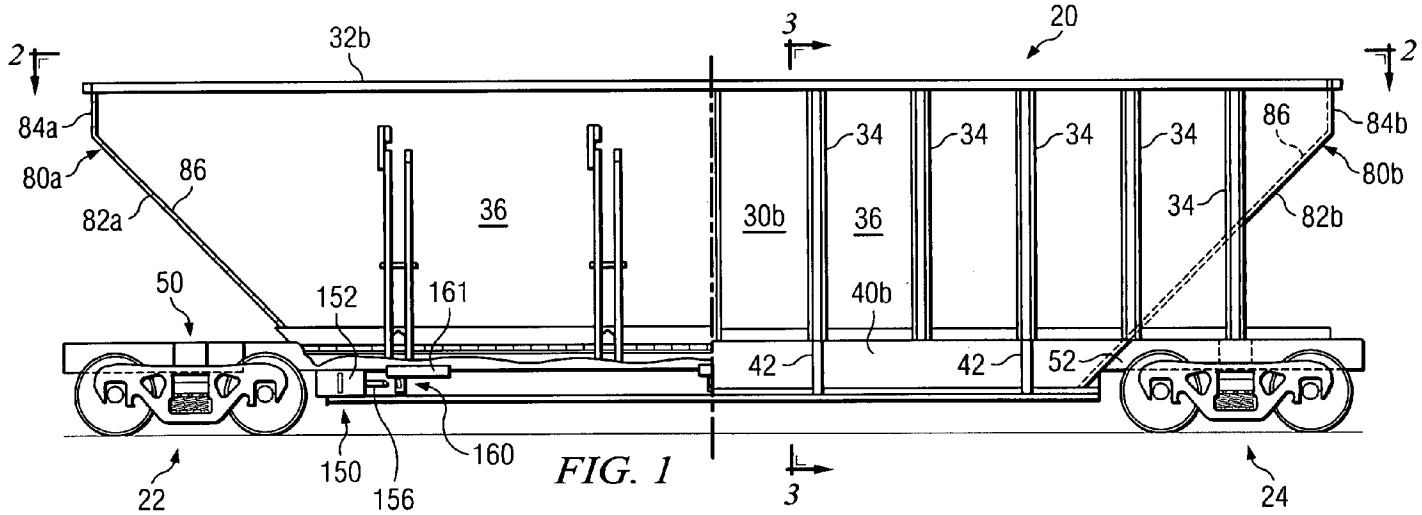
FIG. 1 is a schematic drawing in elevation with portions broken away showing a side view of a hopper car incorporating teachings of the present invention.

Preferred embodiments of the invention and its advantages are best understood by referring to FIGS. 1 through 15C of the drawings. Like numbers may be used for like and corresponding parts of the various drawings.

Various features of the present invention will be described with respect to hopper car 20. Typical dimensions for one embodiment of hopper car 20 incorporating teachings of the present invention may include length between truck centers of forty (40) feet six (6) inches; a length over strikers of fifty (50) feet two and one half (2½) inches; and a length over pulling faces of fifty-three (53) feet and one (1) inch. Hopper car 20 may be satisfactorily used to carry bulk materials such as coal and other types of lading. Examples of additional lading include, but are not limited to, sand, grain, metal ores, aggregate and ballast.

Hopper car 20 may be generally described as an open hopper car with bottom discharge openings or outlets. Respective door assemblies may be open and closed to control discharge of lading from the discharge openings or outlets of hopper car 20. However, the present invention is not limited to open hopper cars or hopper cars used to carry coal. For example various features of the present invention may be satisfactorily used with gondola cars, closed hopper cars, articulate hopper cars, hopper cars that carry grain or any other type of hopper car. Examples of lading carried by such hopper cars may include, but are not limited to, corn distillers dried grains (DDG), corn condensed distillers solubles (CDS), corn distillers dried grains/solubles (DDGS) and wet distillers grain with solubles (WDGS). Such products are frequently associated with ethanol production from corn and/or other types of grain.

Teachings of the present invention may be used with other types of railway cars having interior supporting structures. The present invention is not limited to hopper cars with longitudinal discharge openings. The present invention is not limited to railway cars having discharge control systems as described in this application.

Hopper car 20 incorporating teachings of the present invention may include a pair of sidewall assemblies 30*a*, 30*b*, bottom slope sheet assemblies 40*a* and 40*b* and sloped end wall assemblies 80*a* and 80*b* mounted on railway car underframe 50. For embodiments of the present invention as shown in FIGS. 1–15C, hopper car 20 may be generally described as having a single, open hopper defined in part by sidewall assemblies 30*a*, 30*b*, bottom slope sheet assemblies 40*a* and 40*b* and end wall assemblies 80*a* and 80*b* mounted on railway car underframe 50. Other railcars formed in accordance with teachings of the present invention may include two or more hoppers.

Figure 2:
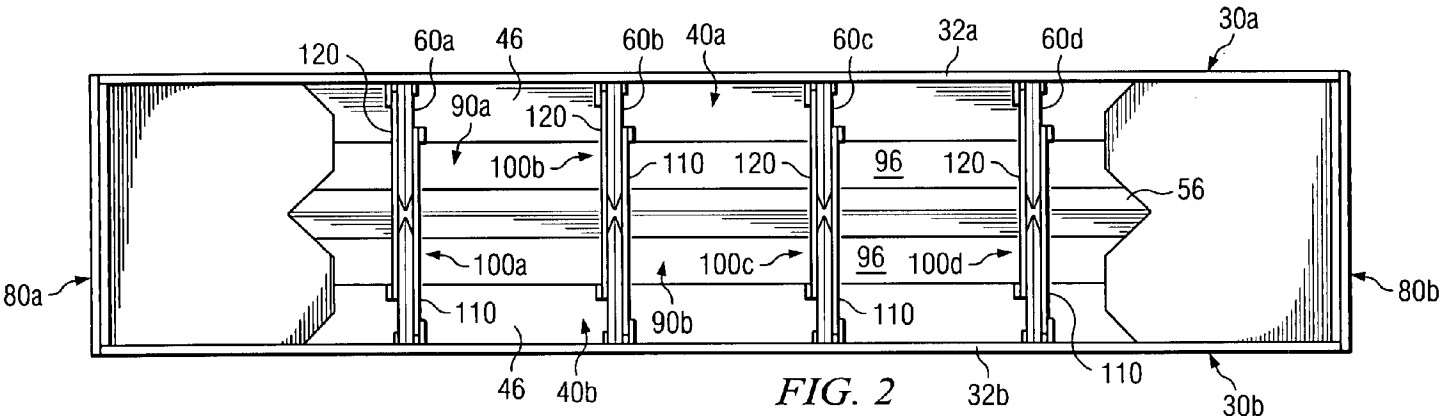
FIG. 2 is a schematic drawing showing a plan view with portions broken away of taken along lines 2—2 of FIG. 1.

Railway car underframe 50 includes center sill 52 and side sills 54*a* and 54*b*. See FIGS. 3, 4 and 8–10. Side sills 54*a* and 54*b* extend generally parallel with center sill 52 and are spaced laterally from opposite sides of center sill 52. In some embodiments, a plurality of cross bearers 60 may be mounted on center sill 52. For embodiments of the present invention as shown in FIGS. 1 and 2, hopper car 20 may include four (40) cross bearers 60. Side sills 54*a* and 54*b* may be attached to opposite ends of cross bearers 60. For the purposes of describing various features of the present invention, cross bearers 60 have been designated 60A, 60B, 60C and 60D.

For some applications a railcar may be formed in accordance with the teachings of the present invention with any number of cross bearers. The present invention is not limited to railcars having cross bearers. Also, the configuration and design of cross bearers associated with a railcar incorporating teachings of the present invention may be substantially modified as compared with cross bearers 60.

A pair of railway trucks 22 and 24 may be attached proximate opposite ends of center sill 52. For embodiments of the present invention as represented by hopper car 20, center sill 52 may have a generally rectangular cross-section with a generally triangular-shaped dome or cover 56 disposed thereon. The present invention may be used with center sills having a wide variety of configurations and designs other than a rectangular cross section. The present invention may be used with center sills that do not have domes or covers. The present invention is not limited to center sill 52 or cover 56.

Sidewall assemblies 30*a* and 30*b* may have approximately the same overall configuration and dimensions. Therefore, only sidewall assembly 30*b* will be described in detail. Sidewall assembly 30*b* preferably includes top cord 32*b* with a plurality of side stakes 34 extending between top cord 32*b* and side sill 54*b*. Side stakes 34 may also be spaced longitudinally from each other along the length of top cord 32*b* and side sill 54*b*. A plurality of metal sheets 36 may be securely attached with interior portions of top cord 32*b*, side stakes 34 and side sill 54*b*. In a similar manner, sidewall assembly 30*a* preferably includes top cord 32*a*, side stakes 34 and metal sheets 36.

For purposes of describing various features associated with the present invention metal sheets 36 which form the interior surface of sidewall assembly 30*a* have been designated 36*a*. In a similar manner metal sheets 36 which form the interior surface of sidewall assembly 30*b* have been designated as 36*b*. See FIGS. 3 and 5.

Bottom slope sheet assemblies 40*a* and 40*b* may have approximately the same overall dimensions and configuration. Therefore, only bottom slope sheet assembly 40*b* will be described in more detail. Bottom slope sheet assembly 40*b* preferably includes a plurality of angles 42 extending inwardly from side sill 54*b* to bottom cord 44*b*. Bottom cord 44*b* and top cord 32*b* may be formed from hollow metal tubes having a generally rectangular configuration. A plurality of metal sheets 46 may be attached with interior surfaces of respective angles 42 and bottom cord 44*b*. Metal sheets 36 and 46 may have similar specifications and thickness.

For some applications, an additional angle 48*b* may be attached to bottom cord 44*b* opposite from angles 42 to provide additional structural strength for hopper car 20. Bottom cord 44*b* and angle 48*b* preferably extend along substantially the full length of hopper car 20. In a similar manner, bottom slope sheet assembly 40*a* preferably includes angles 42, metal sheets 46, bottom cord 44*a* and an additional angle 48*a*.

Bottom slope sheet assemblies 40*a* and 40*b* may be attached with respective side sills 54*a* and 54*b*. Slope sheet assemblies 40*a* and 40*b* preferably extend inward at an angle from respective side sills 54*a* and 54*b* to a location proximate bottom clearance or minimum clearance for hopper car 20 relative to associated railway tracks (not expressly shown). For embodiments of the present invention represented by hopper car 20 slope sheet assemblies 40*a* and 40*b* may extend at an angle of approximately forty five degrees (45°) relative to respective sidewall assemblies 30*a* and 30*b*.

Portions of bottom slope sheet assembly 40*a* cooperate with adjacent portions of center sill 52 and dome 56 to define longitudinal discharge openings 26*a*. In a similar manner portions of bottom slope sheet assembly 40*b* cooperate with adjacent portions of center sill 52 and dome 56 to define in part longitudinal discharge openings 26*b*. See FIGS. 4 and 10. Longitudinal discharge openings 26*a* and 26*b* are preferably disposed along opposite sides of center sill 52. For some applications a hopper car may be formed in accordance with teachings of the present invention with more than one hopper and more than two longitudinal discharge openings. The present invention is not limited to hopper cars with only two longitudinal discharge openings.

A plurality of longitudinal door assemblies 90*a* and 90*b* are preferably hinged proximate the upper portion of center sill 52 adjacent to dome assembly 56. Longitudinal door assemblies 90*a* and 90*b* may also be described as "swinging longitudinal slope sheets." Longitudinal door assemblies 90*a* and 90*b* may be formed with overall dimensions and configurations similar to bottom slope sheet assemblies 40*a* and 40*b*. Attaching longitudinal door assemblies 90*a* and 90*b* proximate the upper portion of center sill 52 in accordance with teachings of the present invention may increase the volume of lading which is carried within hopper car 20 and may also reduce the center of gravity when hopper car 20 is loaded.

Various types of mechanical hinges may be satisfactorily used to respectively engage door assemblies 90 with dome assembly 56 proximate the upper portion of center sill 52. For embodiments of the present invention as shown in FIGS. 3, 4 and 8–10, piano type hinges 92 may be used to rotatably attach or pivotally attach door assemblies 90 proximate upper portions of center sill 52.

Alternatively, hinge assemblies 92 may include any suitable hinge, such as spring, continuous, butt, slip apart, and weld-on hinges, to allow door assemblies 90 to move between an open and closed position. For example, hinge assemblies 92 preferably includes flat plate butt hinges that are bolted between door assemblies 90 and an upper portion of center sill 52 to pivotally move door assemblies 90 between an open and closed position.

For purposes of describing various features of the present invention door assemblies 90 have been designated as 90*a* and 90*b*. Hinge assemblies 72 have been designated as 92*a* and 92*b*.

Figure 5:
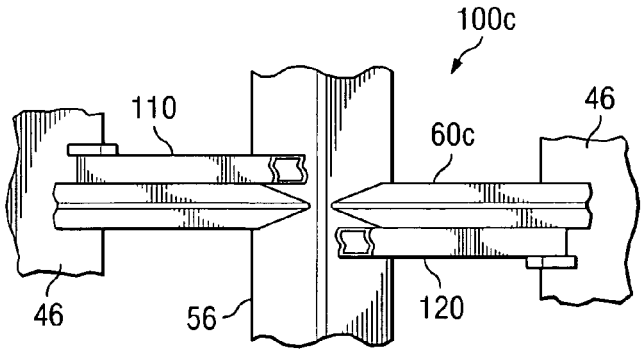
FIG. 5 is a schematic drawing in section taken along lines 5—5 of FIG. 4 with portions broken away showing a plan view of one example of an interior supporting structure incorporating teachings of the present invention.
Figure 6:
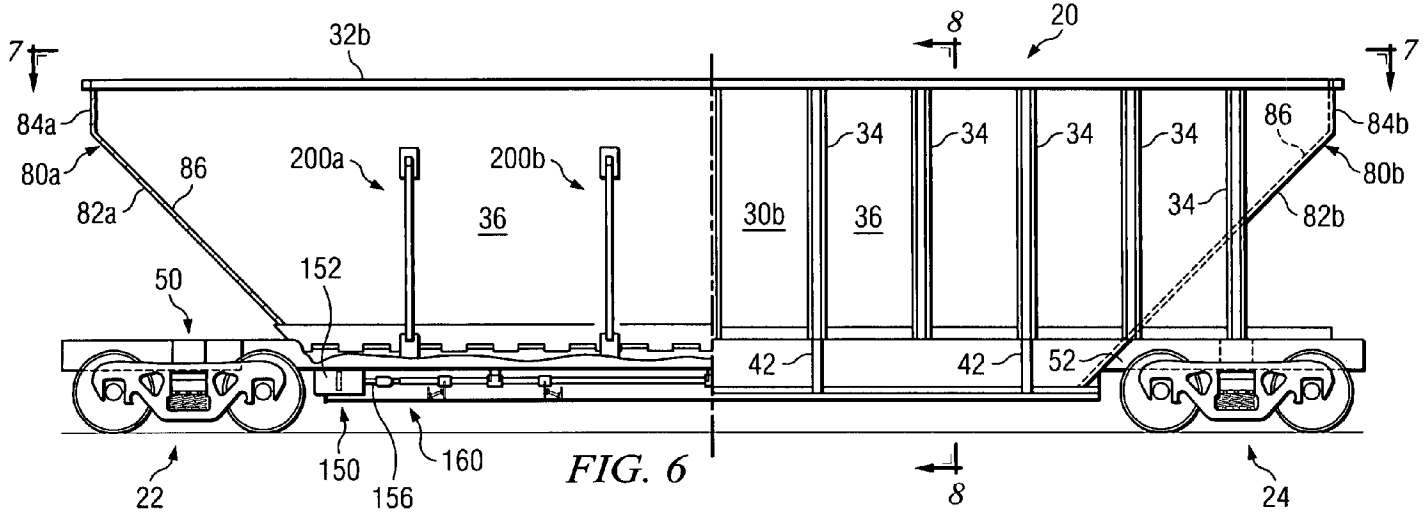
FIG. 6 is a schematic drawing in elevation with portions broken away showing a side view of a hopper car incorporating teachings of the present invention.
Figure 10:
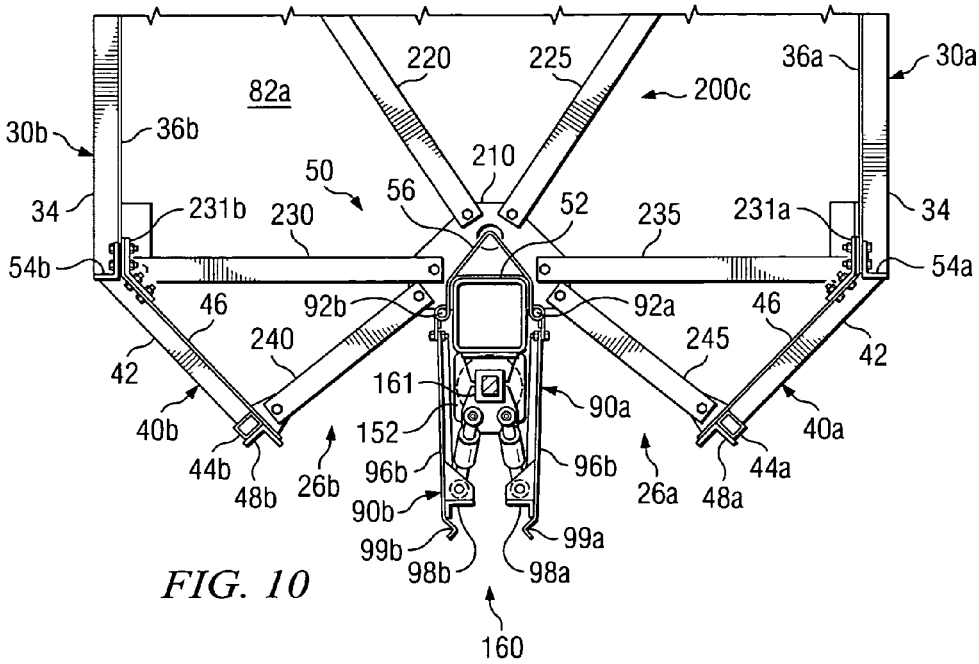
FIG. 10 is a schematic drawing in section with portions broken away showing the longitudinal discharge openings and respective door assemblies of FIG. 8 in their second, open position.
Figure 11C:
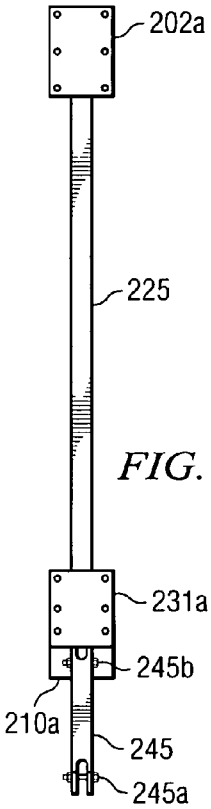
FIG. 11C is a schematic drawing showing a side view of the interior supporting structure of FIG. 11A.
Figure 11D:
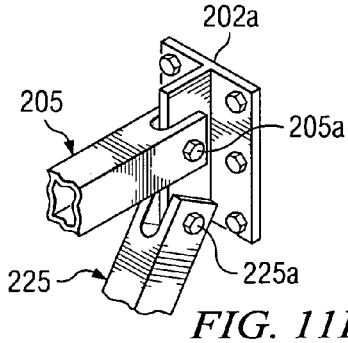
FIG. 11D is a schematic drawing showing an isometric view with portion broken away of the interior supporting structure of FIG. 11A.
Figure 11A:
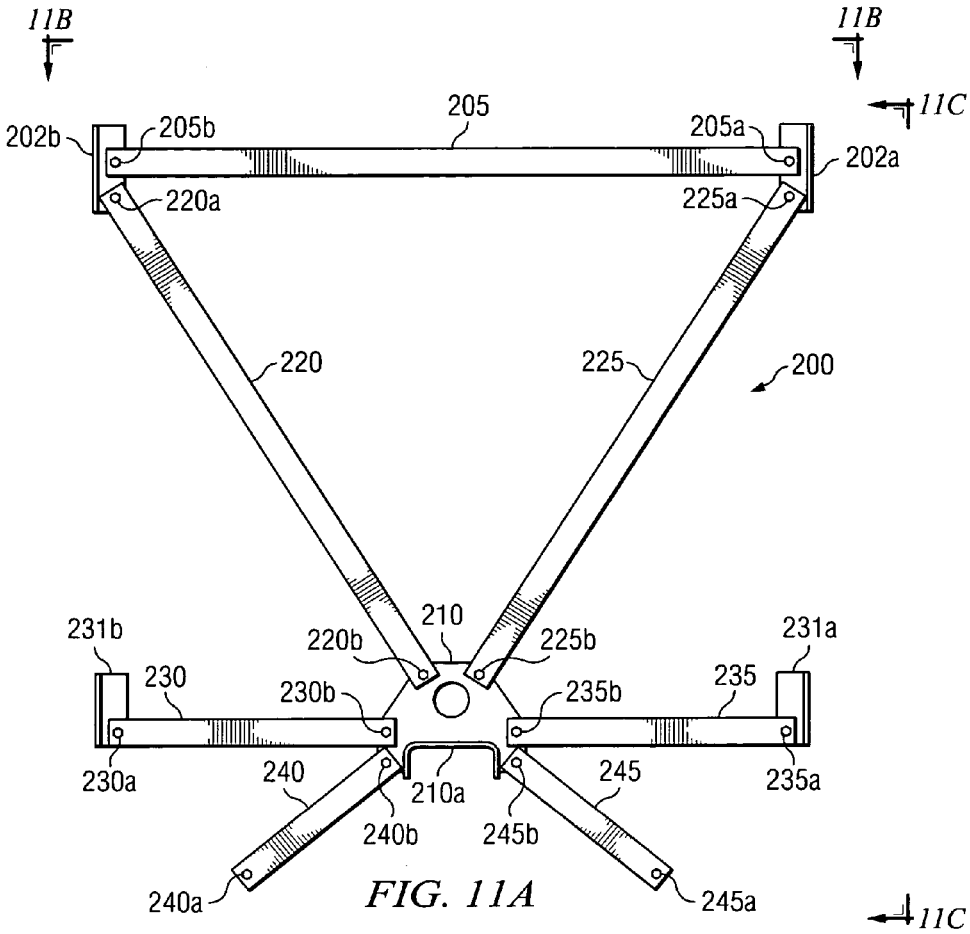
FIG. 11A is a schematic drawing in elevation showing an interior supporting structure incorporating teachings of the present invention.
Figure 11B:
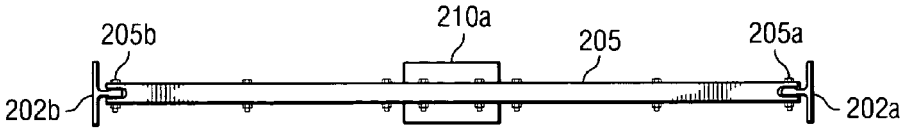
FIG. 11B is a schematic drawing showing a plan view of the interior supporting structure of FIG. 11A.
Figure 12:
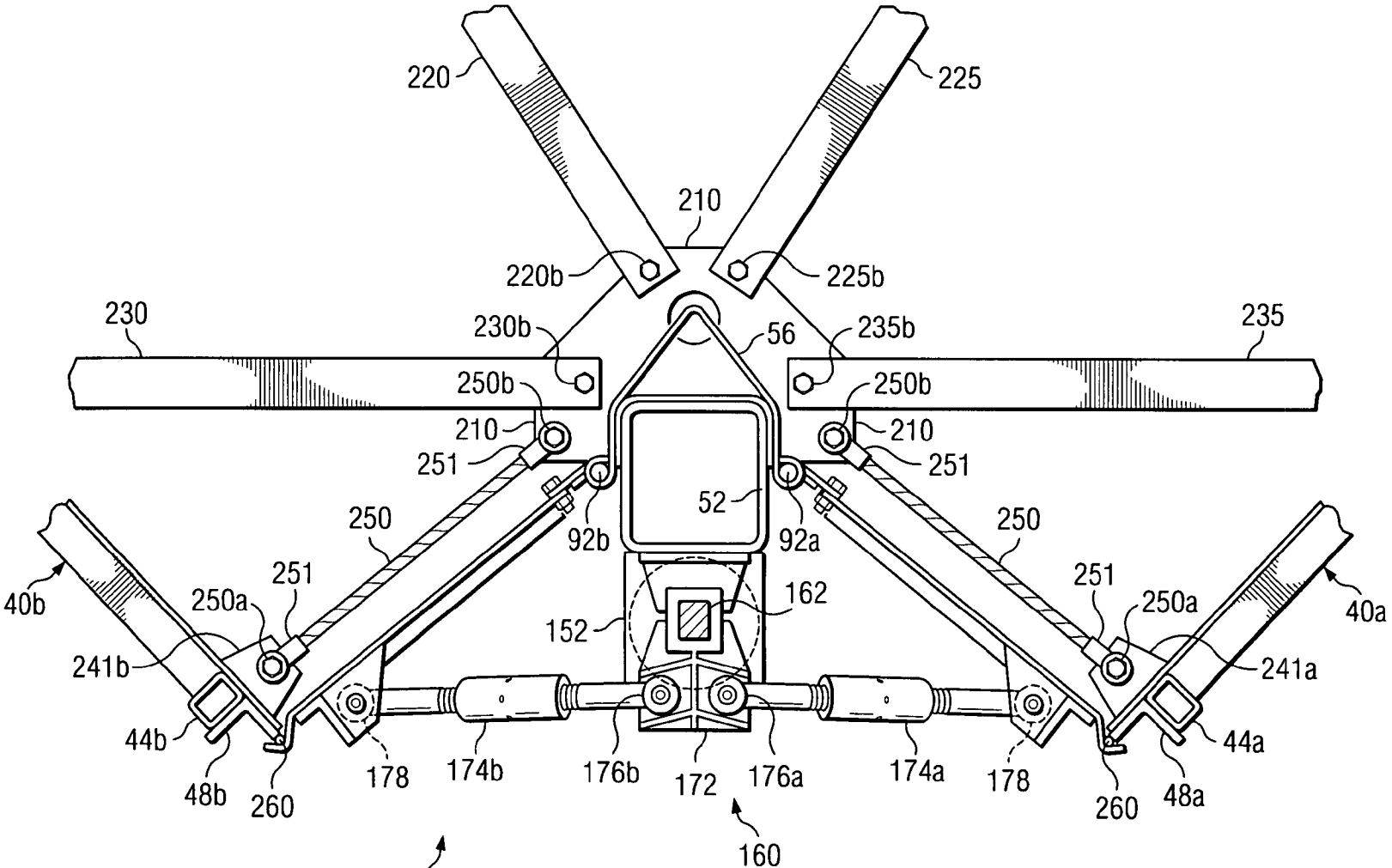
FIG. 12 is a schematic drawing showing an isometric view with portion broken away of an alternate embodiment of the interior supporting structure incorporating teachings of the present invention.

Each door assembly 90*a* and 90*b* preferably includes a first, closed position which prevents the discharge of lading from hopper car 20 (see FIGS. 3 and 8) and a second, open position which allows lading to be discharged from hopper car 20 (see FIGS. 5 and 10). For some applications longitudinal door assemblies 90*a* and 90*b* may be directly attached to or directly coupled with the upper portion of center sill 52. For some applications the length of longitudinal openings 26*a* and 26*b* and door assemblies 90*a* and 90*b* may be approximately twenty-nine (29) feet.

Door assemblies 90 formed in accordance with teachings of the present invention may extend along approximately the full length of respective longitudinal discharge openings 26*a* and 26*b*. The overall empty car weight of hopper car 20 may be reduced as compared to prior hopper cars. As such, the cost associated with manufacture and maintenance of hopper car 20 may also be reduced. Door assembly 90 may be formed using metal plates 96*a* and 96*b* having similar thickness and other characteristics associated with metal plates 36 and 46. Respective angles 98*a* and 98*b* may be attached with the longitudinal edge of each door assembly 98*a* and 98*b* opposite from respective hinges 92*a* and 92*b*. For some application angles 98*a* and 98*b* may be replaced by an I-beam, a Z-beam or any other suitable structural shape.

Figure 4:
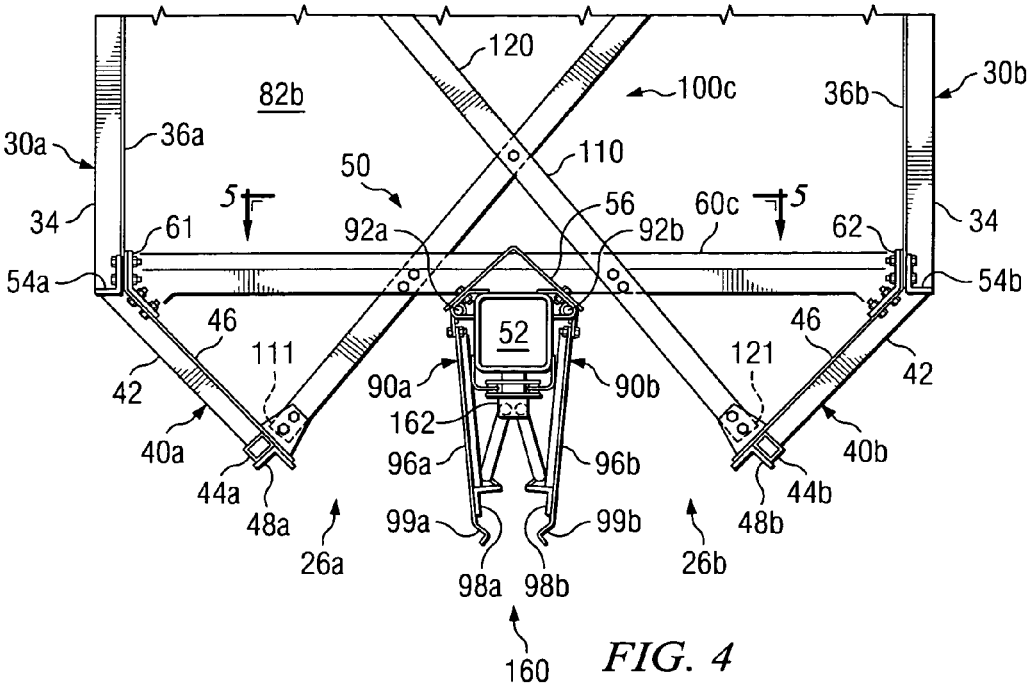
FIG. 4 is a schematic drawing in section with portions broken away showing the longitudinal discharge openings and respective door assemblies of FIG. 3 in their second, open position.

As shown in FIGS. 4 and 10, respective longitudinal recesses 99*a* and 99*b* may be formed along an edge of each door assembly 90*a* and 90*b* opposite from respective hinges 92*a* and 92*b*. The overall dimensions and configuration of recesses 99*a* and 99*b* may be selected to be compatible with the dimensions and configuration of respective angles 48*a* and 48*b*. In some embodiments, outer edge of recesses 99*a* and 99*b* may extend around angles 48*a* and 48*b* when door assembly 90*a* and 90*b* are moved to a closed position.

Figure 3:
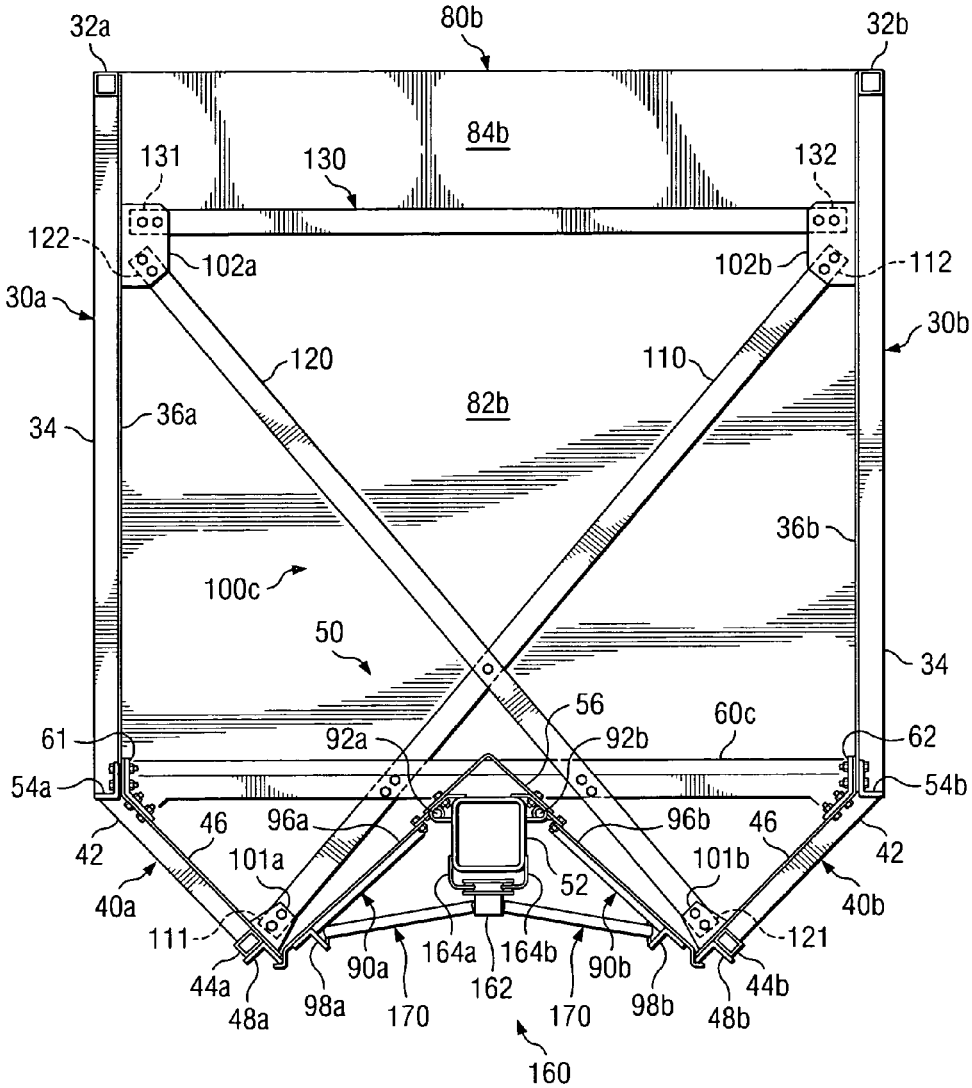
FIG. 3 is a schematic drawing in section with portions broken away taken long lines 3—3 of FIG. 1 showing one example of an interior supporting structure, longitudinal discharge openings and respective door assemblies in their first, closed position.
Figure 8:
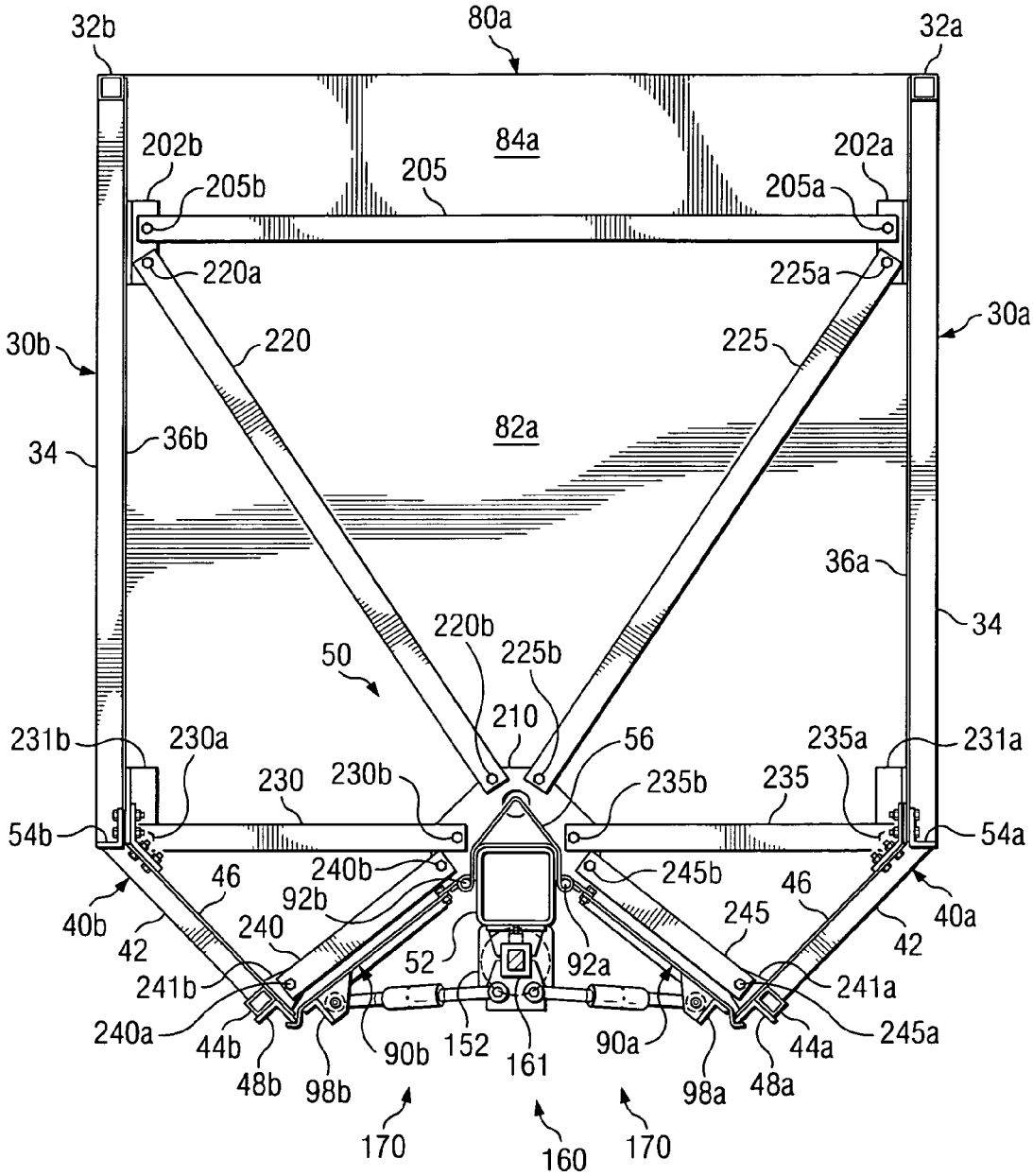
FIG. 8 is a schematic drawing in section with portions broken away taken long lines 8—8 of FIG. 6 showing another example of an interior supporting structure, longitudinal discharge openings and respective door assemblies in their first, closed position.
Figure 9:
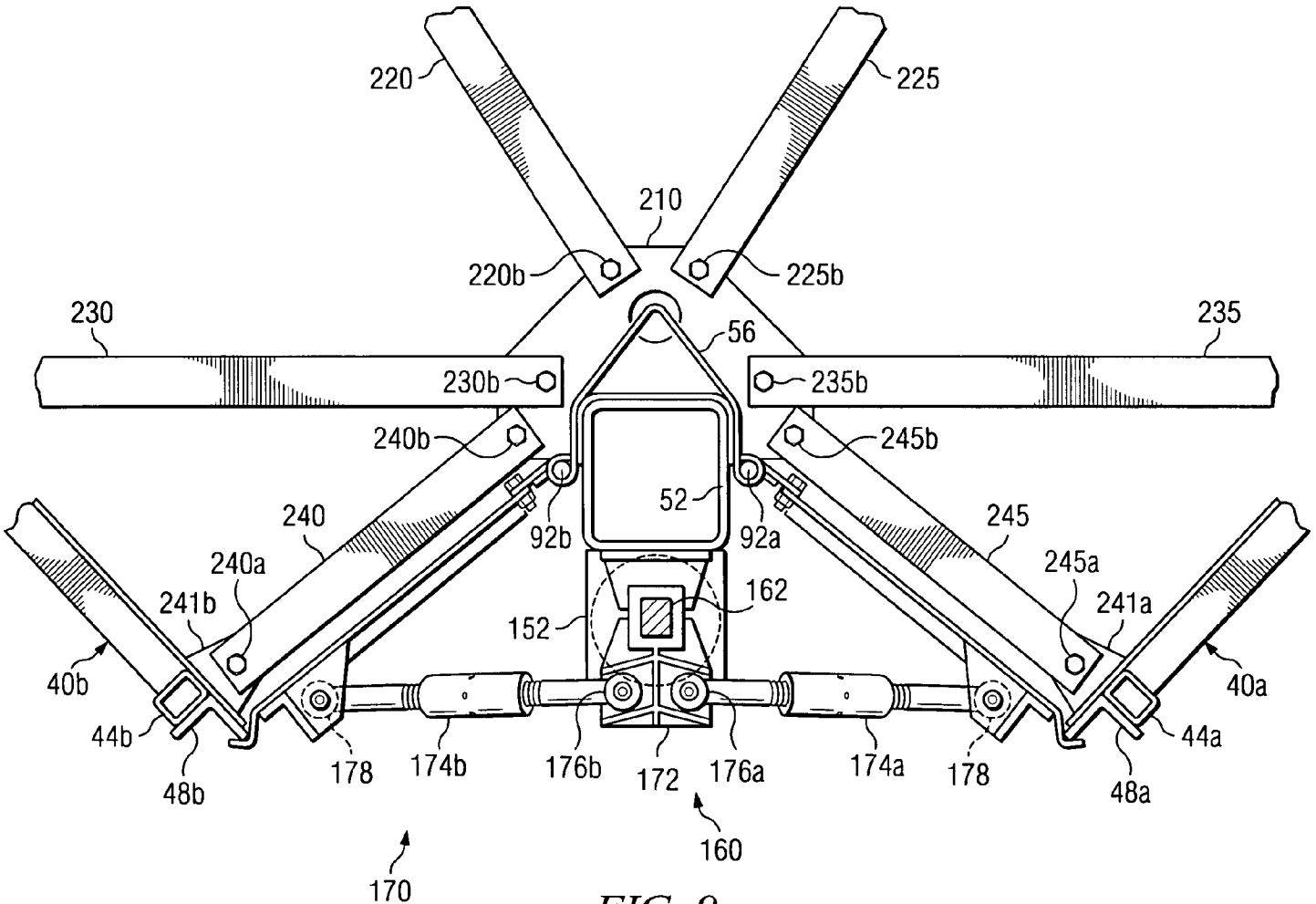
FIG. 9 is an enlarged schematic drawing in section with portions broken away showing another example of an interior supporting structure, longitudinal discharge openings and respective door assemblies in their first, closed position.

As shown in FIGS. 3, 8 and 9 recesses 99*a* and 99*b* cooperate with respective angles 48*a* and 48*b* to help seal respective longitudinal discharge openings 26*a* and 26*b* to eliminate or substantially minimize any leakage of lading from hopper car 20. Various types of sealing mechanisms may be satisfactorily used to engage a door assembly with adjacent portions of a bottom slope sheet assembly in accordance with teaching of the present invention. For example, in grain transportation, hopper car 20 may include gasket 250 disposed on angles 48*a* and 48*b* such that recesses 99*a* and 99*b* compress gasket to minimize leakage of lading from hopper car 20. The present invention is not limited to use with recesses 99 and angles 48.

End wall assemblies 80*a* and 80*b* may have approximately the same overall configuration and dimensions. Therefore, only end wall assembly 80*a* will be described in detail. For some applications end wall assembly 80*a* may include sloped portion 82*a* and a generally vertical portion 84*a*. End wall assembly 80*a* may be formed from one or more metal sheets 86. Metal sheets 86 may have similar thickness and other characteristics associated with metal sheets 36 and 46.

A plurality of interior supporting structures or interior cross brace assemblies 100 and 200 may be disposed within hopper car 20 extending between sidewall assemblies 30*a* and 30*b* and bottom slope sheet assemblies 40*a* and 40*b*. The various components associated with interior supporting structures 100 and 200 cooperate with each other to provide adequate strength and load carrying capabilities for bottom slope sheet assemblies 40*a* and 40*b* while at the same time providing relatively large longitudinal discharge openings 26*a* and 26*b* adjacent to center sill 52.

Interior supporting structures are typically formed from structural members such as plates, angles, bars, channels, beams, tubing, cables, ropes, wires, a combination of different structures, or any other structural member.

Referring to FIGS. 1 through 5, for purposes of describing various features of the present invention interior cross brace assemblies 100 have been designated 100*a*, 100*b*, 100*c* and 100*d*. For other applications, more or fewer interior brace assemblies formed in accordance with teachings of the present invention may be disposed within a railcar incorporating teachings of the present invention.

For embodiments of the present invention as shown in FIGS. 1–5 interior cross brace assemblies 100*a*, 100*b*, 100*c* and 100*d* may have substantially the same configuration and dimensions. Therefore, various features of the invention will be described with respect to interior cross brace assembly 100*c*. For some applications, the dimensions and/or configuration of interior brace assemblies disposed within a hopper car may be varied in accordance with teachings of the present invention. For example one or more cross brace assemblies may be formed with larger or smaller components as compared with other cross brace assemblies associated with the hopper car.

Hopper cars may be formed with fewer than four cross brace assembly 100 but may also be formed with more than five cross brace assembly 100. In some embodiments of the present invention, hopper car 20 is formed with three cross brace assembly 100. Also, partitions (not expressly shown) may be used in place of interior cross brace assemblies.

Respective diagonal braces 110 and 120 preferably extend between sidewall assemblies 30*a* and 30*b* and bottom slope sheet assemblies 40*a* and 40*b* for each interior cross brace assembly 100*a*, 100*b*, 100*c* and 100*d*. For the embodiment of the present invention represented by interior brace assembly 100*c* as shown in FIG. 3, first end 111 of diagonal brace 110 may be secured proximate bottom cord 44*a* and angle 48*a* of bottom slope sheet assembly 40*a* by connector 101*a*. Second end 112 of diagonal brace 110 may be secured with sidewall assembly 30*b* by connector 102*b*. In a similar manner first end 121 of diagonal brace 120 may be secured proximate bottom cord 44*b* and angle 48*b* of bottom slope sheet assembly 40*b* by connector 101*b*. Second end 122 of diagonal brace 120 may be secured to sidewall assembly 30*a* by connector 102*a*.

As shown in FIG. 5 diagonal brace 110 may be coupled with one side of cross bearer 60*c*. Diagonal brace 120 may be coupled with the opposite side of cross bearer 60*c*. For some applications cross bearer 60*c* may include a generally triangular-shaped configuration to accommodate discharge of lading from the car plane.

Horizontal crosspiece or brace 130 preferably extends between sidewall assemblies 30*a* and 30*b*. First end 131 of horizontal crosspiece or brace 130 may be engaged with connector 102*a*. Second end 132 of horizontal brace 130 may be securely engaged with connector 102*b*. Connectors 102*a* and 102*b* are preferably mounted on interior surfaces of sidewall assemblies 30*a* and 30*b* spaced from top chords 32*a* and 32*b* at locations generally aligned with respective horizontal cross bearers 60*a*, 60*b*, 60*c* and 60*d*. The vertical location of each horizontal brace 130 relative to center sill 52 may correspond approximately with the intersection of end wall portions 82*a* and 84*a* and/or end wall portions 82*b* and 84*b*.

FIGS. 6–11D show another example of an interior supporting structure or interior brace assembly 200 which may be disposed within hopper car 20 extending between sidewall assemblies 30*a* and 30*b* and bottom slope sheet assemblies 40*a* and 40*b*. Various components associated with interior supporting structure 200 cooperate with each other to provide adequate strength and load carrying capabilities for bottom slope sheet assemblies 40*a* and 40*b* while at the same time providing relatively large longitudinal discharge openings 26*a* and 26*b* adjacent to center sill 52.

For embodiments of the present invention as shown in FIGS. 6–11D interior cross brace assemblies 200*a*, 200*b*, 200*c* and 200*d* may have substantially the same configuration and dimensions. Therefore, various features of the invention will be described with respect to interior cross brace assembly 200*c*. For some applications, the dimensions and/or configuration of interior brace assemblies disposed within a hopper car may be varied in accordance with teachings of the present invention.

For example one or more cross brace assemblies may be formed with larger or smaller components as compared with other cross brace assemblies associated with the hopper car. In some embodiments, cross brace assembly 100 are formed of different sized members or components. For example, in one embodiment, cross brace assembly 100 includes a reduced cross-section member such as a cable (shown below in more detail) to form a brace component.

Hopper cars may be formed with fewer than four cross brace assembly 200 but may also be formed with more than five cross brace assembly 200. In some embodiments of the present invention, hopper car 20 is formed with three cross brace assembly 200. In yet other embodiments, hopper car 20 is formed with brace assembly 100, brace assembly 200 or any combination thereof. Also, partitions (not expressly shown) may be used in place of interior cross brace assemblies.

Interior brace assembly 200 may sometimes be referred to as a "rib plate assembly". Interior cross brace assembly 200*c* preferably includes rib plate 210 centered over and coupled to center sill 52 at bracket 210*a*.

Rib plate 210 may be securely mounted on and attached with center sill 52. A generally U-shaped bracket 210*a* may be formed as an integral component of rib plate 210. Bracket 210*a* preferably includes dimensions compatible with the upper portion of center sill 52.

Various types of mechanical fasteners such as bolts and huck fasteners and/or welding techniques may be satisfactorily used to securely engage bracket 110*a* with center sill 52.

Each interior brace assembly 200 preferably includes respective horizontal cross bearers 230 and 235 extending from respective side sills 54*a* and 54*b* and connecting to rib plate 210. Typically, horizontal cross bearers 230 and 235 are preferably attached to and extend generally laterally from rib plate 210. Various types of mechanical fasteners such as bolts and huck fasteners and/or welding techniques may be satisfactorily used to securely attach interior brace assembly 200. For example, horizontal cross bearer 230 may bolt to respective side sill 54*b* using plate member 231*b* at first end 230*a* and second end 230*b* of cross bearer 230 couples with rib plate 210. Similarly, cross bearer 235 may connect to respective side sill 54*a* using plate member 231*a* at first end 235*a* and second end 235*b* of cross bearer 235 couples with rib plate 210.

Upper diagonal braces 220 and 225 preferably extend between sidewall assemblies 30*a* and 30*b* and rib plate 210. For the embodiment of the present invention as shown in FIG. 8, first end 220*a* of upper diagonal brace 220 may be secured proximate sidewall assembly 30*b* at connector plate 202*b* and extend diagonally to connect with rib plate 210 at second end 220*b*. Similarly, first end 225*a* of upper diagonal brace 225 may be secured proximate sidewall assembly 30*a* by connector plate 202*a* and extend diagonally to connect with rib plate 210 at second end 225*a*.

Lower diagonal braces 240 and 245 preferably extend between bottom slope sheet assemblies 40*a* and 40*b* and rib plate 210. First end 240*a* of lower diagonal brace 240 preferably couples to bottom cord 44*b* and angle 48*b* of bottom slope sheet assembly 40*b* being secured by connector plate 241*b*. Second end 240*b* of lower diagonal brace 240 may be secured with rib plate 210. In a similar manner first end 245*a* of lower diagonal brace 245 may be connected with bottom cord 44*a* and angle 48*a* of sloped sheet assembly 40*a* by connector plate 241*a*. Second end 245*b* of lower diagonal brace 245 may be secured with rib plate 210.

Horizontal crosspiece 205 preferably extends between sidewall assemblies 30*a* and 30*b*. First end 205*a* of horizontal crosspiece 205 may be engaged with connector 202*a*. Second end 205*b* of horizontal crosspiece 205 may be securely engaged with connector plate 202*b*. Pairs of connector plates 202*a* and 202*b* are preferably mounted on interior surfaces of sidewall assemblies 30*a* and 30*b* at locations generally aligned with respective horizontal cross bearers 230 and 235.

Figure 7:
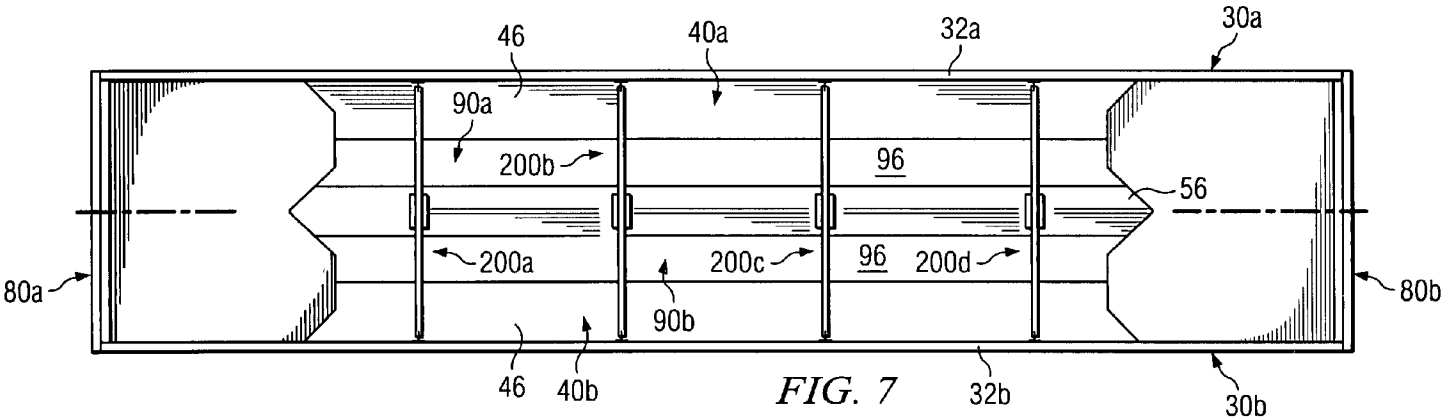
FIG. 7 is a schematic drawing showing a plan view with portions broken away of taken along lines 7—7 of FIG. 6.

FIG. 7 illustrates a schematic drawing showing an isometric view with portion broken away of an alternate embodiment of the interior supporting structure 200. In some embodiments, cross brace assembly 200 includes a reduced cross section member such as cable 250 and 255 in lieu of one or more braces such as lower diagonal braces 240 and 245. Typically, cable 250 and 255 is constructed from aircraft quality stainless steel cable. By reducing the cross section of certain interior members, hopper car 20 may rapidly discharge lading.

In some embodiments, cross brace assembly 200 may be disposed adjacent end wall assembly 80. Reduced cross section member such as cable 250 and 255 may allow lading to exit hopper car 20 more freely than with lower diagonal brace 240 and 245.

In some embodiments, cable 250 and 255 preferably extend between bottom slope sheet assemblies 40*a* and 40*b* and rib plate 210. First end 251*a* of cable 250 preferably couples to bottom cord 44*b* and angle 48*b* of bottom slope sheet assembly 40*b* being secured by connector plate 241*b*. Second end 250*b* of cable 250 may be secured with rib plate 210. In a similar manner first end 255*a* of cable 255 may be connected with bottom cord 44*a* and angle 48*a* of sloped sheet assembly 40*a* by connector plate 241*a*. Second end 255*b* of cable 255 may be secured with rib plate 210.

Cables 250 and 255 may further include sleeve (not expressly shown) used to couple cable 250 and 255 at connector plates 241*a*, 241*b* and rib plate 210. Also, cables 250 and 255 may be formed or cut to length such that cable anchors 251 may be used to form a loop with each end of the cable. In other embodiments, cables 250 and 255 may be pre-formed and formed to length for assembly into hopper car 20.

Various types of operating assemblies and door closing mechanisms may be satisfactorily used to open and close longitudinal door assemblies or gates 90*a* and 90*b*. For the embodiments shown in FIGS. 1–15C discharge control system 160 may include operating assembly or opening and closing assembly 150 along with door connector assembly 170.

Discharge control system 160 incorporating teachings of the present invention generally has pivot points and linkages and no torsion members, incorporates over center locking, and simplified adjustment. Discharge control system 160 incorporating teachings of the present system may operate gates or doors 90*a* and 90*b* by pushing or pulling with air cylinder 152, hydraulic cylinder or other type of actuator via a common linkage such as clevis 180 centered under center sill 52 of railcar 20 or highway truck (not expressly shown) longitudinally. The common linkage or clevis 180 may be attached to secondary linkages such as bar 162 and arms 174*a* and 174*b* that connect to door assemblies 70 or gates 90*a* and 90*b* on both sides that are swung up or down depending on the direction of the common linkage.

Gates 90*a* and 90*b* may be hinged proximate center sill 52 or other centrally located structure with hinges 92*a* and 92*b* oriented longitudinally and above the common linkage. Each secondary linkage such as arm 174*a* and 174*b* provides the lower horizontal leg of a triangular shaped mechanism consisting of gate 90*a* and 90*b* as the hypotenuse and the common linkage such as bar 162 and centrally located structure or center sill 52 as the upright leg in a closed position. The secondary linkages such as arms 174*a* and 174*b* may be pushed or pulled past center to provide a positive lock on gates 90*a* and 90*b*, commonly known as over center locking. The secondary linkages may be symmetrical to each other and provide an equilibrium of the transverse forces both while operating and in a locked position.

Only relatively simple adjustments are required such as lengthening or shortening secondary linkages such as arms 174*a* and 174*b* until respective gates 90*a* and 90*b* are closed with sufficient preload. An over center lock is adjusted by a stop (not expressly shown) at the end of the common linkage such as bar 162 which can be adjusted longitudinally to increase or decrease the desired travel of the common linkage. The secondary linkages or arms 174*a* and 174*b* rotate into a compound angle mainly oriented in the longitudinal direction parallel to the common linkage when gates 90*a* and 90*b* are in the open position and rotate into a mainly perpendicular position to the common linkage when gates 90*a* and 90*b* are in the closed position. Additional secondary links (not expressly shown) can be added to carry heavier loads between gates 90*a* and 90*b* and the common central linkage such as bar 162. Multiple gate arc travel (not expressly shown) can be accomplished by changing the secondary linkages lengths.

Figure 13:
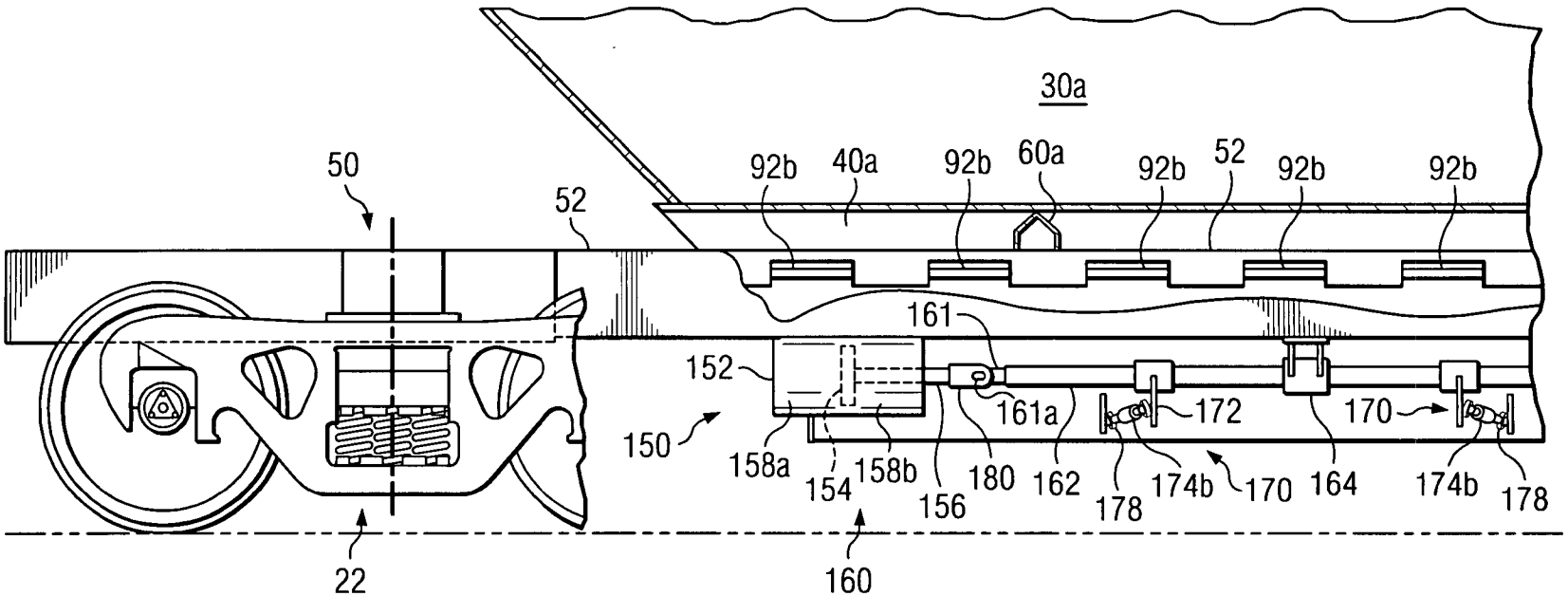
FIG. 13 is a schematic drawing in section with portions broken away showing one example of an operating mechanism satisfactory for moving door assemblies incorporating teachings of the present invention between a first, closed position and a second, open position.
Figure 14:
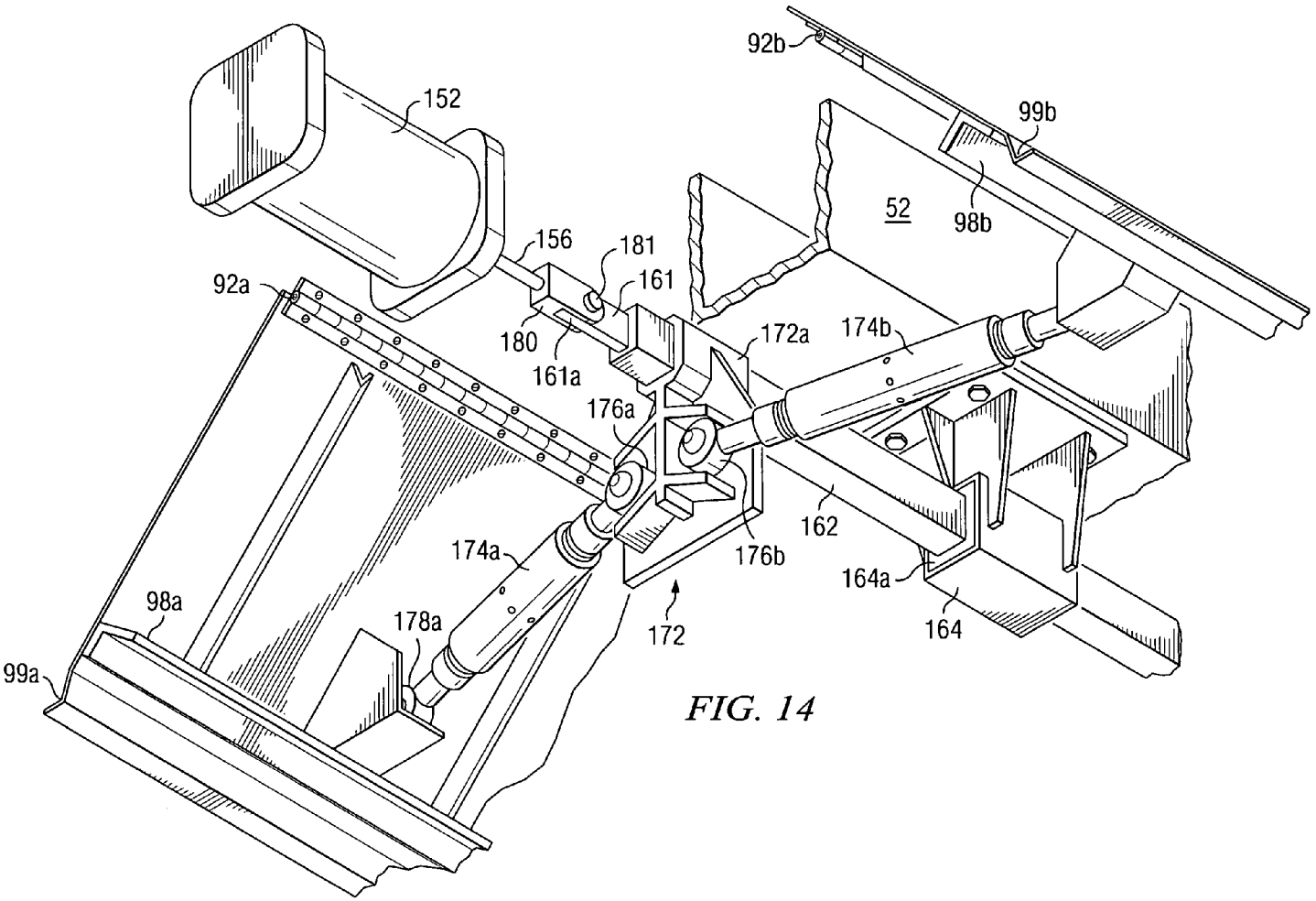
FIG. 14 is an schematic drawing showing an isometric view with portion broken away of the operating mechanism of FIG. 13.

As shown in FIGS. 1, 3, 4, 6, 8–10 and 12–15*c*, operating assembly 150 preferably includes air cylinder 152 with piston 154 and piston rod 156 slidably disposed therein. Piston 154 divides the interior of air cylinder 152 into two variable volume fluid chambers 158*a* and 158*b*. Air pressure may be applied to chamber 158*a* or 158*b*. Air pressure may be released from or vented from the other variable volume fluid chamber 158*a* or 158*b* to move or reciprocate piston rod 156 longitudinally relative to center sill 52 and other components associated with railway car underframe 50 as shown in FIGS. 13 and 14.

Typically, air cylinder 152 is formed proximate to a lower portion of the hopper such as proximate center sill 52. However, air cylinder 152 may be formed, located, placed, coupled or disposed with any portion of hopper car 20. In one embodiment of the present invention, air cylinder 152 is located beneath center sill 52.

In alternate embodiments of the present invention, operating assembly 150 may replace or supplement air cylinder 152 with any suitable drive actuator for providing a reciprocating longitudinally movement relative to center sill 52 and other components associated with railway car underframe 50. For example, operating assembly 150 may include an electrically operated motor (not expressly shown). Other examples of drive actuators including, but not limited to, hydraulic actuators, pneumatic actuators, electric actuators, manual actuators such as geared drives, and any other suitable drive actuators.

One end of piston rod 156 is preferably connected to for fitted with clevis 180 that connects with an adjacent end of plank or connector plate 161. For embodiments of the invention as shown in FIGS. 13 and 14, connector plate or plank 161 preferably includes a connection end that interconnect with clevis 180 such as with pin 181 inserted through eye 161*a* of plank 161. The opposing end of connector plank 161 includes a generally rectangular cross section that connects to bar 162. For some applications connector plank 161 may extend along substantially the full length of discharge controlled system 160 longitudinally relative to center sill 52. For other applications two or more operating assemblies may be coupled with center sill 52 in accordance with teachings of the present invention. In yet other applications, connector plank 161 may form a part of bar 162 such that bar 162 connects directly with clevis 180.

Connectors or brackets 164 may be attached with center sill 52 and respectively engaged with bar 162. Generally, the dimensions of bracket 164 are preferably selected to allow bar 162 to slide or move within bracket 164 longitudinally with respect to center sill 52. Bracket 164 may be used to maintain bar 162 within a respective distance from center sill and in alignment with respect to center sill 52 and door assembly 90. In some embodiments, an insert member 164*a* may be disposed between bar 162 and bracket 164 to reduce the friction of the sliding motion.

For embodiments of the present invention as shown in FIGS. 3, 8, 9 and 12–15*c*, each door 90*a* and 90*b* may include one or more respective door connector assemblies 170. Each door connector assembly 170 preferably includes a respective boss or socket 172 attached with bar 162 at coupling point 172*a* opposite from center sill 52. Each door connector assembly 170 also preferably includes a pair of arms 174*a* and 174*b* which may extend laterally from operating assembly 150 to engage respective longitudinal door assemblies 90*a* and 90*b*. First end 176*a* and 176*b* of each arm 174*a* and 174*b* preferably includes a respective ball joint (not expressly shown) which may be rotatably engaged with socket or boss 172. Second end 178*a* and 178*b* of each arm 174*a* and 174*b* may be rotatably engaged with each door assembly 90*a* and 90*b* opposite from associated hinges spaced from respective hinges 92*a* and 92*b*. FIG. 15B illustrates door assembly 90 in a partially open position such that arms 174*a* and 174*b* are controlling the movements of door assembly 90 throughout their range of motion.

Figure 15A:
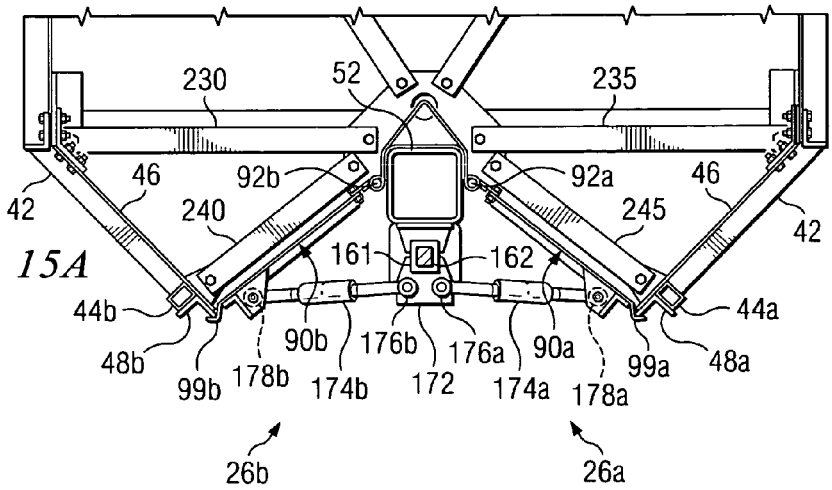
FIGS. 15A through 15C are enlarged schematic drawings in section with portions broken away showing one example of the longitudinal discharge openings and respective door assemblies moving between a first, closed position and a second, open position.
Figure 15B:
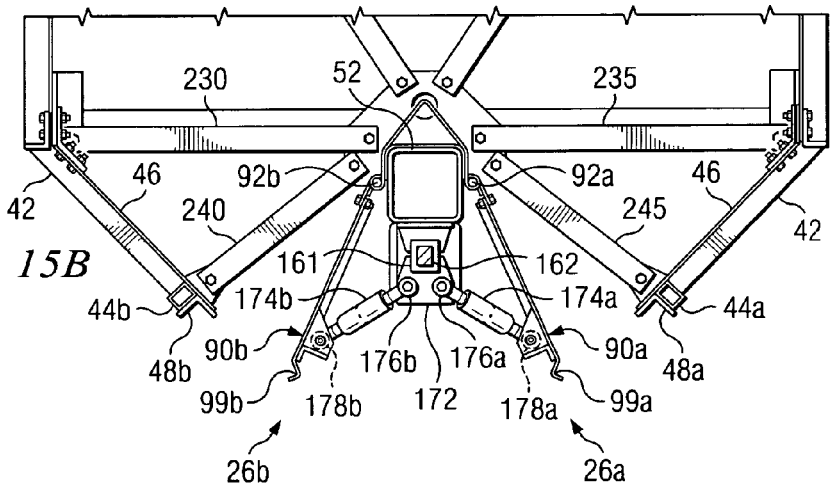
Figure 15C:
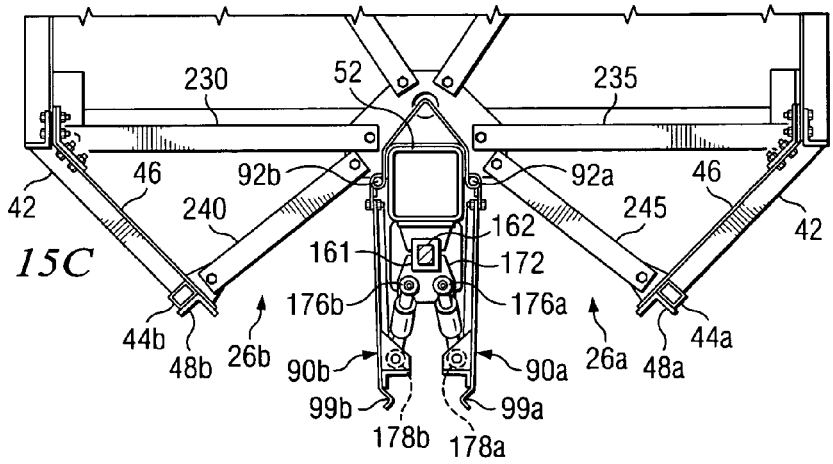

Referring to FIGS. 15A through 15C, longitudinal movement of bar 162 will result in radial extension of arms 174*a* and 174*b* to move door assembly 90*a* and 90*b* from their second, open position (see FIGS. 4, 10 and 15C) to their first, closed position (see FIGS. 3, 8 and 15A). Movement of bar 162 in the opposite direction relative to center sill 52 will result in pulling or moving door assemblies 90*a* and 90*b* from their first position to their second, open position which allows rapid discharge of any lading contained within railway hopper car 20 as shown in FIG. 15C.

Although the present invention and its advantages have been described in detail, it should be understood that various changes, substitutions and alternations can be made herein without departing from the spirit and scope of the invention as defined by the following claims.

What is claimed is:

1. A railcar having an underframe, a pair of sidewall assemblies and at least one hopper formed between the sidewall assemblies, the hopper car comprising:

the underframe having a center sill and a pair of side sills;

the center sill disposed between the pair of side sills and extending along a generally longitudinal axis of the railcar;

the center sill having a cross-section defined by an upper portion and a lower portion;

the hopper having at least one discharge opening extending generally longitudinally adjacent to the center sill;

a respective discharge door operably disposed adjacent to each longitudinal discharge opening to control flow of lading from each hopper;

each discharge door extending longitudinally along the center sill and rotatably hinged longitudinally from an upper portion of the center sill for movement between a first, closed position and a second, open position relative to the respective discharge opening;

a door operating mechanism operable coupled to a portion of each discharge door; and the door operating mechanism operable to move longitudinally along the longitudinal axis of the railcar to cause each discharge door to move between the respective first position and the respective second position.

2. The railcar of claim 1 further comprising an open hopper car.

3. The railcar of claim 1 further comprising a closed hopper car.

4. The railcar of claim 1 further comprising two hoppers.

5. The railcar of claim 1, further comprising a recess formed along an opposite edge from the hinged portion of each discharge door, the recess operable to cooperate with a portion of the discharge opening to substantially minimize leakage of lading from the hopper.

6. The railcar of claim 5, further comprising an angle member forming a part of the discharge opening wherein the angle member operably receives a portion of the recess.

7. The railcar of claim 6, further comprising a gasket disposed between the angle member and the recess operable to minimize leakage of lading from the discharge opening.

8. The railcar of claim 1, further comprising the discharge openings and respective discharge doors extending for a length of approximately twenty-nine (29) feet.

9. The railcar of claim 1, further comprising a respective hinge proximately disposed along the center sill, the hinge operable to couple the associated discharge door to the center sill.

10. The railcar of claim 9, wherein the hinge comprises a piano type hinge.

11. A railcar having a pair of sidewall assemblies mounted on an underframe, the railcar comprising:

the underframe having a generally rectangular configuration defined in part by a pair of side sills spaced laterally from each other;

a center sill disposed between the side sills along a generally longitudinal axis of the railcar;

a plurality of cross bracing structures extending between the underframe and the pair of sidewall assemblies;

the plurality of cross bracing structures disposed on and space longitudinally from each other along the center sill;

each cross bracing structure defined in part by a rib plate, a first and second horizontal cross bearer members, a first and second upper diagonal cross brace members and a first and second lower diagonal cross brace members;

each rib plate coupled to a portion of the center sill;

the first and second horizontal cross bearer members operably extending generally laterally from the rib plate, each horizontal cross bearer member operable to couple the respective rib plate to one of the side sills;

the first and second upper diagonal cross brace members coupled to and extending from an upper portion of the respective sidewall assembly, each upper diagonal cross brace member operable to be engaged with the respective rib plate; and the first and second lower diagonal cross brace members coupled to and extending from a lower portion of the respective sidewall assembly, each lower diagonal cross brace member operable to be engaged with the respective rib plate.

12. The railcar of claim 11 further comprising an open hopper car.

13. The railcar of claim 11 further comprising a closed hopper car.

14. The railcar of claim 11 further comprising a gondola car.

15. The railcar of claim 11, wherein the plurality of cross bracing structures comprises three (3) cross bracing structures disposed along the center sill of the railcar.

16. The railcar of claim 11 wherein the plurality of cross bracing structures comprises four (4) cross bracing structures disposed along the center sill of the railcar.

17. The railcar of claim 11 wherein the plurality of cross bracing structures comprises five (5) cross bracing structures disposed along the center sill of the railcar.

18. The railcar of claim 11 further comprising at least one hopper with at least one discharge opening formed proximate to a lower portion of the hopper.

19. The railcar of claim 18 further comprising a respective door assembly mounted adjacent to each discharge opening to control the flow of lading from the hopper, wherein the door assembly operably moves between a closed position and an open position relative to the discharge opening.

20. The railcar of claim 11 further comprising:

a respective rib plate bracket forming a part of each rib plate; and each rib plate bracket operable to couple the respective rib plate to the center sill.

21. The railcar of claim 20 wherein each rib plate bracket including dimensions compatible with the center sill.

22. The railcar of claim 11 wherein the horizontal cross bearer members, the upper diagonal cross brace members and the lower diagonal cross brace members comprise structural members selected from a group consisting of plates, angles, bars, cables, ropes, wires, channels, beams, tubing and any combination thereof.

23. The railcar of claim 11 further comprising a reduced cross section member forming one or more components of the cross bracing structure.

24. The railcar of claim 11 wherein the lower diagonal cross brace members comprise a reduced cross section member.

25. The railcar of claim 24 wherein the reduced cross section member comprises a cable.

26. A method of forming a railcar operable to discharge lading from at least one hopper disposed between a pair of sidewall assemblies, the method comprising:

forming a railcar underframe defined in part by a center sill extending along a generally longitudinal axis of the railcar;

mounting the sidewall assemblies on a pair of side sills of the underframe;

forming at least one discharge opening from the hopper adjacent to the center sill such that the discharge opening extends generally longitudinally along the center sill;

rotatably coupling a respective discharge door assembly extending longitudinally relative to a portion of the center sill adjacent to each longitudinal discharge opening such that each discharge door assembly moves between a first, closed position and a second, open position relative to the respective discharge opening; and installing a discharge door mechanism operable to move generally longitudinally relative to the longitudinal axis of the railcar to cause each discharge door assembly to move between the respective first position and the respective second position.

27. The method of claim 26, further comprising reducing the cross section of at least one interior cross brace member.

28. The method of claim 27 wherein reducing the cross section further comprises selecting a cable member for use as a portion of the interior cross brace member.

29. The method of claim 26 further comprising disposing a gasket on the at least one discharge opening whereby substantially reducing leakage of lading from the hopper.

30. A method of bracing an interior structure of a railcar having an underframe, a pair of sidewall assemblies and at least one hopper formed between the sidewall assemblies, the method comprising:

disposing a plurality of cross bracing structures along a center sill extending generally along a longitudinal axis of the railcar;

spacing each cross bracing structures longitudinally from each other along the center sill;

defining an upper portion and a lower portion of the center sill;

coupling a rib plate to the upper portion of the center sill;

extending upper diagonal cross brace members from an upper portion of respective sidewall assemblies, each upper diagonal cross brace member operable to be engaged with the rib plate;

extending lower diagonal cross brace members from a lower portion of the respective sidewall assemblies, each lower diagonal cross brace member operable to be engaged with the rib plate; and extending a horizontal cross bearer member from a respective side sill, each horizontal cross bearer member operable to be engaged with the rib plate.

31. The method of claim 30, further comprising:

forming a rib plate bracket to provide a portion of the rib plate; and coupling the rib plate to the center sill using the rib plate bracket.

32. The method of claim 30, further comprising forming the rib plate bracket with dimensions compatible with the center sill.

33. The method of claim 30, further comprising forming the cross bracing structures using structural members selected from a group consisting of plates, angles, bars, cables, ropes, wires, channels, beams, tubing and any combination thereof.

34. The method of claim 30 wherein the railcar further comprises an open hopper car.

35. The method of claim 30 wherein the railcar further comprises a closed hopper car.

36. The method of claim 30 wherein the railcar further comprises a gondola car.

37. The method of claim 30 further comprising installing three (3) cross bracing structures along the center sill of the railcar.

38. The method of claim 30 further comprising installing four (4) cross bracing structures along the center sill of the railcar.

39. The method of claim 30 further comprising installing five (5) cross bracing structures along the center sill of the railcar.

* * * * *

US007080598C1

(12) EX PARTE REEXAMINATION CERTIFICATE (6975th)

United States Patent

Creighton et al.

(10) Number: US 7,080,598 C1

(45) Certificate Issued: Aug. 4, 2009

(54) RAILWAY HOPPER CAR WITH LONGITUDINAL DISCHARGE OPENINGS

(75) Inventors: George S. Creighton, Flower Mound, TX (US); Joseph M. Sindelar, Houston, TX (US); John C. Herzog, West Chester, OH (US)

(73) Assignee: TRN Business Trust, Dallas, TX (US)

Reexamination Request:
No. 90/008,461, Jan. 26, 2007

Reexamination Certificate for:

| | |
|---|---|
| Patent No.: | **7,080,598** |
| Issued: | **Jul. 25, 2006** |
| Appl. No.: | **10/926,381** |
| Filed: | **Aug. 25, 2004** |

Related U.S. Application Data

(60) Provisional application No. 60/498,105, filed on Aug. 26, 2003.

(51) Int. Cl.
*B61D 3/00* (2006.01)

(52) U.S. Cl. ..... 105/247

(58) Field of Classification Search ..... 105/247, 105/249–251, 280, 282.2, 290
See application file for complete search history.

(56) References Cited

U.S. PATENT DOCUMENTS

| | | | | | |
|---|---|---|---|---|---|
| 686,902 | A | * | 11/1901 | Hitchcock | 105/290 |
| 707,416 | A | | 8/1902 | Hornbrook et al. | |
| 728,029 | A | | 5/1903 | Shepard | |
| 775,402 | A | * | 11/1904 | Müller et al. | 105/290 |
| 971,603 | A | | 10/1910 | Goodwin | |
| 1,076,011 | A | | 10/1913 | Campbell | |
| 1,092,659 | A | | 4/1914 | Mettler | |
| 1,164,918 | A | | 12/1915 | Campbell | |
| 1,209,809 | A | | 12/1916 | Campbell | |
| 1,284,111 | A | * | 11/1918 | Kestler | 105/251 |
| 1,405,415 | A | * | 2/1922 | Hochberg | 105/251 |
| 1,482,559 | A | | 2/1924 | Hart | |
| 2,167,362 | A | | 7/1939 | Hindahl | |
| 2,684,642 | A | | 7/1954 | Dorey | |
| 2,888,883 | A | | 6/1959 | Fritz et al. | |
| 3,137,247 | A | | 6/1964 | Hamilton et al. | |
| 3,316,858 | A | * | 5/1967 | Fritz | 105/290 |
| 3,343,725 | A | | 9/1967 | Cannon | |
| 3,434,433 | A | | 3/1969 | Floehr | |
| 3,447,485 | A | | 6/1969 | Dorey | |
| 3,455,253 | A | | 7/1969 | Floehr | |
| 3,610,485 | A | | 10/1971 | Van Raden | 222/564 |
| 3,656,437 | A | | 4/1972 | Kuzmicki | 105/240 |
| 3,789,772 | A | | 2/1974 | Bullard | 105/240 |
| 4,138,948 | A | | 2/1979 | Korolis | 105/251 |
| 4,224,877 | A | | 9/1980 | Stark et al. | 105/250 |
| 4,235,169 | A | | 11/1980 | Peterson | 105/251 |
| 4,250,814 | A | * | 2/1981 | Stark et al. | 105/251 |
| 4,580,502 | A | | 4/1986 | Ritzl et al. | 105/240 |
| 4,754,710 | A | | 7/1988 | Kieres | 105/355 |
| 6,955,126 | B2 | | 10/2005 | Taylor | 105/250 |
| 6,955,127 | B2 | | 10/2005 | Taylor | 105/299 |
| 7,080,599 | B2 | | 7/2006 | Taylor | 105/290 |

OTHER PUBLICATIONS

Del Vecchio et al. "Center Flow Covered Hoppers" in Trains; Feb. 2000; vol. 60, iss. 2; pp. 42–47; [retrieved online Nov. 13, 2007], from Research Library database (Document ID 47751012). <http://proquest.umi.com/pqdweb?did=47751012&sid=1&Fmt=4&clientId=19649&RQT=309&VName=PQD>.*

* cited by examiner

*Primary Examiner*—Sara S Clarke

(57) ABSTRACT

A railcar with longitudinal discharge openings is disclosed. In one embodiment, the railcar includes an underframe, a pair of sidewall assemblies and a hopper formed between the sidewall assemblies. The underframe has a center sill and a pair of side sills. The center sill disposed between the pair of side sills along a generally longitudinally axis of the railcar. The hopper includes a discharge opening adjacent to the center sill. A respective discharge door assembly disposed adjacent to each discharge opening to control flow of lading from each hopper. Each discharge door may hinge from the center sill for movement between a first position and a second position relative to the discharge openings.

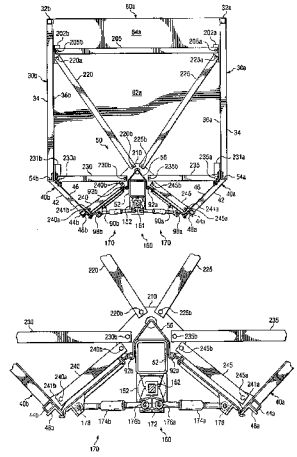

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 26 are determined to patentable as amended.

New claims 40–44 are added and determined to be patentable.

Claims 2–25 and 27–39 were not reexamined.

1. A railcar having an underframe, a pair of sidewall assemblies and at least one hopper formed between the sidewall assemblies, the hopper car comprising:

the underframe having a center sill and a pair of side sills;

the center sill disposed between the pair of side sills and extending along a generally longitudinal axis of the railcar;

the center sill having a cross-section defined by an upper portion and a lower portion;

the hopper having at least [one discharge opening] *two longitudinal discharge openings* extending generally longitudinally adjacent to *and along opposite sides of* the center sill;

*a respective bottom slope sheet assembly attached to each side sill;*

*each bottom slope sheet assembly including a plurality of angles extending inwardly at an angle from the respective side sill to a respective bottom cord;*

*a plurality of metal sheets attached with respective interior surfaces of the angles and the bottom cord;*

*at least one respective diagonal brace coupled to and extending from the respective bottom cord of each of the bottom slope sheet assemblies;*

*portions of each bottom slope sheet assembly cooperating with adjacent portions of the center sill to define in part a respective longitudinal discharge opening;*

*each longitudinal discharge opening extending generally longitudinally adjacent to one of the respective bottom slope sheet assemblies;*

*each longitudinal discharge opening defined at least in part by the bottom cord of the respective bottom slope sheet assembly spaced from the respective side sill;* a respective discharge door operably disposed adjacent to each longitudinal discharge opening to control flow of lading from each hopper;

each discharge door extending longitudinally along the center sill and rotatably hinged longitudinally from an upper portion of the center sill for movement between a first, closed position and a second, open position relative to the respective *longitudinal* discharge opening;

a door operating mechanism [operable] *operably* coupled to a portion of each discharge door;

*a plurality of brackets securely connected below the center sill of the railway car to allow portions of the door operating mechanism to move longitudinally within the bracket relative to the center sill;* and the door operating mechanism operable to move longitudinally along the longitudinal axis of the railcar to cause each discharge door to move between the respective first position and the respective second position.

26. A method of forming a railcar operable to discharge lading from at least one hopper disposed between a pair of sidewall assemblies, the method comprising:

forming a railcar underframe defined in part by a center sill extending along a generally longitudinal axis of the railcar *and a pair of side sills with the center sill disposed between the side sills*;

*respectively* mounting the *pair of* sidewall assemblies on [a] *the* pair of side sills of the *railcar* underframe;

*installing a respective bottom slope sheet assembly on each side sill with each bottom slope sheet assembly extending inward at an angle from the respective side sill and the respective sidewall assembly mounted thereon;*

*installing respective diagonal braces coupled to and extending from one edge of each bottom slope sheet assembly;* forming at least [one discharge opening] *two longitudinal discharge openings* from the *at least one* hopper adjacent to the center sill such that the [discharge opening extends] *at least two longitudinal discharge openings extend* generally longitudinally along *opposite sides* the center sill *with the at least two longitudinal discharge openings defined at least in part by one bottom slope sheet assembly of the pair of bottom slope sheet assemblies*;

rotatably coupling a respective discharge door assembly *proximate to an upper portion of the center sill with each respective discharge door assembly* extending longitudinally relative to a portion of the center sill adjacent to each longitudinal discharge opening such that each discharge door assembly moves between a first, closed position and a second, open position relative to the respective *longitudinal* discharge opening; and installing a discharge door mechanism operable to move generally longitudinally relative to the longitudinal axis of the railcar to cause each discharge door assembly to move between the respective first position and the respective second position*; and*

*wherein installing the discharge door mechanism includes installing a plurality of brackets connected with and extending below the center sill of the railcar to allow portions of the common linkage to move longitudinally within each bracket relative to the center sill at a respective distance from the center sill and in alignment with the center sill and each discharge door mechanism.*

*40. The railcar according to claim 1, further comprising:*

*a respective recess formed proximate to and extending along one edge of each discharge door opposite from the hinged portion of the respective discharge door; and*

*each recess operable to cooperate with an edge of the respective bottom slope sheet assembly to substantially*

*reduce leakage of lading from the hopper when the associated discharge door is in the closed position.*

*41. The railcar according to claim 1 further comprising:*

*each sidewall assembly respectively disposed on one of the side sills with the pair of sidewall assemblies spaced from each other on opposite sides of the center sill; and*

*each diagonal brace extending from the bottom cord of the associated bottom slope sheet assembly to an upper portion of the sidewall assembly disposed on the side sill opposite from the associated bottom slope sheet assembly.*

*42. The railcar according to claim 1 further comprising:*

*at least one rib plate assembly disposed on and securely attached to the center sill; and*

*each diagonal brace extending between the bottom cord of the associated bottom slope sheet assembly and the rib plate; and*

*each diagonal brace securely engaged with the associated rib plate.*

*43. The railcar according to claim 10 further comprising:*

*each sidewall assembly respectively disposed on one of the side sills with the pair of sidewall assemblies spaced from each other on opposite sides of the center sill; and*

*each diagonal brace extending from the bottom cord of the associated bottom slope sheet assembly to an upper portion of the sidewall assembly disposed on the side sill opposite from the associated bottom slope sheet.*

*44. The railcar according to claim 10 further comprising:*

*at least one rib plate assembly disposed on and securely attached to the center sill; and*

*each diagonal brace extending between the bottom cord of the associated bottom slope sheet assembly and the rib plate; and*

*each diagonal brace securely engaged with the associated rib plate.*

* * * * *